US009944301B2

(12) United States Patent
Brewster

(10) Patent No.: US 9,944,301 B2
(45) Date of Patent: Apr. 17, 2018

(54) RAILCAR DECK CHANNEL PIVOTING SIDE WALL APPARATUS AND METHODS OF MAKING AND USING THE SAME

(71) Applicant: Holland LP, Crete, IL (US)

(72) Inventor: John B. Brewster, Homewood, IL (US)

(73) Assignee: Holland, L.P., Crete, IL (US)

( * ) Notice: Subject to any disclaimer, the term of this patent is extended or adjusted under 35 U.S.C. 154(b) by 268 days.

(21) Appl. No.: 14/697,861

(22) Filed: Apr. 28, 2015

(65) Prior Publication Data

US 2015/0344043 A1 Dec. 3, 2015

Related U.S. Application Data

(60) Provisional application No. 61/985,248, filed on Apr. 28, 2014.

(51) Int. Cl.
*B61D 45/00* (2006.01)

(52) U.S. Cl.
CPC ..... *B61D 45/001* (2013.01)

(58) Field of Classification Search
CPC .... B61D 45/001; B61D 45/00; B61D 45/002; B61D 45/003; B61D 45/004; B61D 45/006; B61D 45/007; B60P 7/0815; B60P 7/0807; B60P 3/079; B60P 3/073; B60P 7/06; B63B 25/28; F16B 37/045; F16B 7/187; H02G 3/0418; H02G 3/0437; E04B 1/4107; B62D 25/2054; B64C 1/20; B64D 11/0696; B64D 9/003; E05D 5/0238
See application file for complete search history.

(56) References Cited

U.S. PATENT DOCUMENTS 3,713,616 A * 1/1973 Bowers ..... B60P 7/0815 410/105
4,242,022 A * 12/1980 Fredrickson ..... B60P 7/0807 410/107
4,398,564 A * 8/1983 Young ..... H02G 3/0418 138/155
4,665,812 A * 5/1987 Huang ..... A23B 4/0053 118/326
5,024,251 A * 6/1991 Chapman ..... H01R 4/304 138/155
6,107,575 A * 8/2000 Miranda ..... H02G 3/0437 174/101
6,315,141 B1 * 11/2001 Brennan, Jr. ..... B60P 7/13 220/1.5
9,056,580 B2 * 6/2015 Baldsiefen ..... B60Q 3/06
(Continued)

FOREIGN PATENT DOCUMENTS

DE 10 2009 010 635 * 9/2010
EP 0 562 499 * 9/1993
EP 1 693 525 * 2/2006

*Primary Examiner* — Mark Le
(74) *Attorney, Agent, or Firm* — Scherrer Patent & Trademark Law, P.C.; Stephen T. Scherrer; Monique A. Morneault

(57) ABSTRACT

A railcar deck channel pivoting side wall apparatus and methods of making and using the same are provided. Specifically, the railcar deck channel pivoting side wall apparatus comprises a pivoting side wall arranged within a railcar deck channel to allow for the easy installation and/or removal of chain assemblies on railcar decks for the transport of heavy items thereon.

20 Claims, 4 Drawing Sheets

(56) References Cited

U.S. PATENT DOCUMENTS

| | | | | |
|---|---|---|---|---|
| 2012/0181409 | A1* | 7/2012 | Hayahara | B60N 2/01575<br>248/429 |
| 2014/0160776 | A1* | 6/2014 | Sura | B60P 7/0807<br>362/485 |

* cited by examiner

-PRIOR ART-

RAILCAR DECK CHANNEL PIVOTING SIDE WALL APPARATUS AND METHODS OF MAKING AND USING THE SAME

The present invention claims priority to U.S. Provisional Pat. App. No. 61/985,248, titled "Railcar Deck Channel Pivoting Side Wall Apparatus and Methods of Making and Using the Same", filed Apr. 28, 2014, which is incorporated by reference herein in its entirety.

TECHNICAL FIELD

The present invention relates to a railcar deck channel pivoting side wall apparatus and methods of making and using the same. Specifically, the railcar deck channel pivoting side wall apparatus comprises a pivoting side wall arranged within a railcar deck channel to allow for the easy installation and/or removal of chain assemblies on railcar decks for the transport of heavy items thereon.

BACKGROUND

Commonly, railcars transport cargo, such as large heavy items, by transporting the same on railcar decks and tying the items down using chains or straps typically using hooks to anchor the chains or straps, to an anchoring device configured to attach to the railcar deck.

In many cases, railcar decks have a plurality of channels configured on a surface thereof for holding the securement or anchoring member. The securement or anchoring members may be moved through the channels to dispose the same at desired locations along the railcar deck. The channels allow the securement or anchoring members to be disposed at deck level without unduly protruding from the deck channels. FIG. 1 illustrates a prior art railcar deck 1 carrying heavy machinery 2 thereon. The railcar deck 1 has a plurality of anchor channels 3 running longitudinally in the railcar deck 1. Anchors 4 are disposed within the channels 3 to anchor chains or straps 5 to tie-down the heavy machinery 2.

While railcar deck channels are useful for moving securement or anchoring members in various locations on a railcar, oftentimes it is difficult to install or remove the anchors within the channels. Railcar decks are used for transporting all many of large cargo and heavy machinery, and it is often necessary to utilize several anchors in various locations on the railcar deck to properly secure the same. A need, therefore, exists for railcar deck channels that allow for easy installation and/or removal of anchors. Moreover, a need exists for railcar deck channels providing easy movement of anchors for securing many different types of cargo, including, for example, heavy machinery and the like on railcars.

Oftentimes, anchors that are disposed within railcar deck channels cannot be easily removed once placed within the channels. Loading crews often damage existing channels when removing or installing the anchors. For example, railcar deck channels typically contain slotted flanges on the tops thereof that may be utilized to hold the anchors. In many cases, loading crews bend or break the slotted flanges to remove the anchors from the railcar deck channels. A need, therefore, exists for railcar deck channels allowing loading crews to easily remove or install anchors without causing damage to the railcar deck channels or to the anchors. Specifically, a need exists for railcar deck channels allowing loading crews to remove or install anchors therein without bending or breaking the slotted flanges that may be disposed on a top of the deck channels.

Railcar deck channels are disposed in many railcars used to transport heavy cargo, and a large number of railcars may be subject to damage. Because of the difficulty in moving, removing and/or installing anchors to the railcar deck channels, many railcars may not be utilized to their fullest, and often railcars having difficulty with moving, removing and/or installing anchors are scrapped or minimally used. A need, therefore, exists for railcar deck channels allowing for a plurality of anchor configurations so that the existing railcars may be utilized to their fullest. A need further exists for railcar deck channels that may be newly manufactured or retrofitted to allow for easy movement, removal and/or installation of the securement or anchoring members.

SUMMARY OF THE INVENTION

The present invention relates to a railcar deck channel pivoting side wall apparatus and methods of making and using the same. Specifically, the railcar deck channel pivoting side wall apparatus comprises a pivoting side wall arranged within a railcar deck channel to allow for the easy installation and/or removal of chain assemblies on railcar decks for the transport of heavy items thereon.

To this end, in an embodiment of the present invention, a deck channel pivoting side wall apparatus is provided. The deck channel pivoting side wall apparatus comprises an arm extending from a sleeve, with a pin disposed within the sleeve, said pin rigidly engageable with a railcar deck channel, said arm further comprising a plurality of flanges for holding a deck channel anchor when disposed within a railcar deck channel.

In an alternate embodiment of the present invention a deck channel is provided. The deck channel comprises a first side wall, a second side wall and a bottom wall, the first side wall comprises a first flange comprising a plurality of slots, and the second side wall comprises a second flange with a plurality of slots, the flanges and the plurality of slots for holding a securement anchor within the deck channel, wherein the deck channel further comprises a pivoting side wall section disposed in the first side wall, said pivoting side wall section comprising a pivot sleeve, and arm extending from the arm, and an arm flange disposed on the arm comprising a plurality of slots therein, wherein the pivoting side wall section pivots about a pin, said pivot disposed through the pivot sleeve, said pivoting side wall having an up position and a down position, said pivoting side wall section disposed in an open section in the first side wall.

It is, therefore, an advantage and objective of the present invention to provide railcar deck channels that allow for easy installation and/or removal of anchors.

Moreover, it is an advantage and objective of the present invention to provide railcar deck channels providing easy movement of anchors for securing many different types of cargo, including, for example, heavy machinery and the like on railcars.

In addition, it is an advantage and objective of the present invention to provide railcar deck channels whereupon loading crews may easily remove or install anchors without causing damage to the railcar deck channels or to the anchors.

Specifically, it is an advantage and objective of the present invention to provide railcar deck channels allowing loading crews to remove or install anchors therein without bending or breaking the slotted flanges that may be disposed on a top of the deck channels.

Further, it is an advantage and objective of the present invention to provide railcar deck channels allowing for a plurality of anchor configurations so that the existing railcars may be utilized to their full potential.

Still further, it is an advantage and objective of the present invention to provide railcar deck channels that may be newly manufactured or retrofitted to allow for easy movement, removal and/or installation of the anchors.

Additional features and advantages of the present invention are described in, and will be apparent from, the detailed description of the presently preferred embodiments and from the drawings.

BRIEF DESCRIPTION OF THE DRAWINGS

The drawing figures depict one or more implementations in accord with the present concepts, by way of example only, not by way of limitations. In the figures, like reference numerals refer to the same or similar elements.

DETAILED DESCRIPTION OF THE PRESENTLY PREFERRED EMBODIMENTS

The present invention relates to a railcar deck channel pivoting side wall apparatus and methods of making and using the same. Specifically, the railcar deck channel pivoting side wall apparatus comprises a pivoting side wall arranged within a railcar deck channel to allow for the easy installation and/or removal of anchors and chain assemblies on railcar decks for the transport of heavy items thereon.

Figure 1:
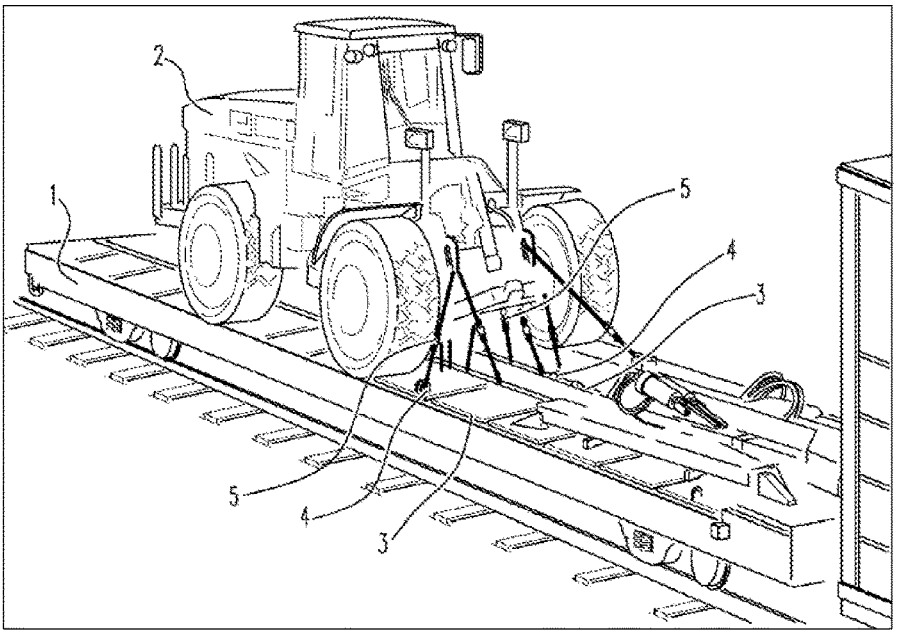
FIG. 1 illustrates a prior art railcar deck showing deck channels, securement anchors, and chains and straps for securing heavy cargo thereon.

Now referring to the figures, wherein like numerals refer to like parts, FIG. 1 illustrates a prior art railcar having a railcar deck 1 with a plurality of deck channels 3 therein for holding chain or strap anchors 4 for securing the heavy cargo 2 disposed thereon. The plurality of channels 3 allows a plurality of anchor configurations to provide anchoring points where desired.

Figure 2:
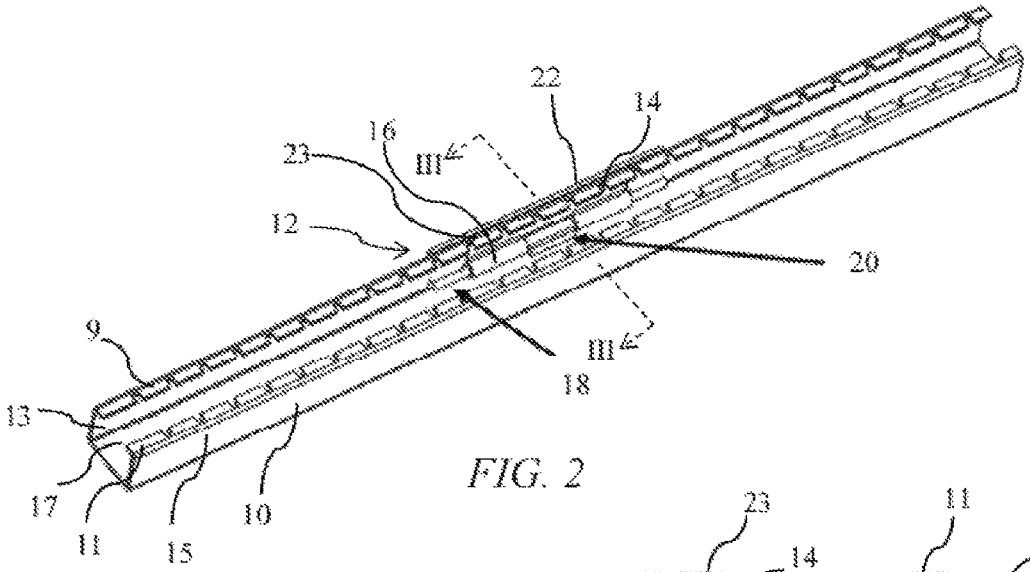
FIG. 2 illustrates a perspective view of a railcar deck channel pivoting side wall system with a pivoting side wall in an up position in an embodiment of the present invention.

FIG. 2 illustrates a railcar deck channel 10 having a first side wall 13, a second side wall 15, a bottom wall 17, said first side wall having a slotted flange 9 and a second side wall having a slotted flange 11 therein on the top of the railcar deck channel 10 for holding anchors therein to allow chains and/or straps to be utilized to tie-down cargo on a railcar. Although the railcar deck channel 10 is shown alone and not within a railcar deck, it should be apparent to one of ordinary skill in the art that the deck channel 10 may be incorporated into the railcar deck for attachment of anchors thereto for hauling of heavy cargo.

Figure 3:
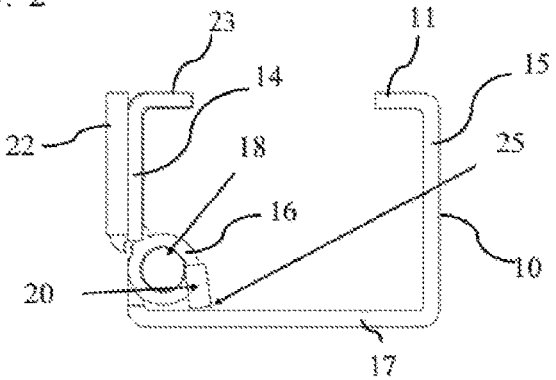
FIG. 3 illustrates a cross-sectional view of a railcar deck channel pivoting side wall system with a pivoting side wall in an up position in an embodiment of the present invention.
Figure 5:
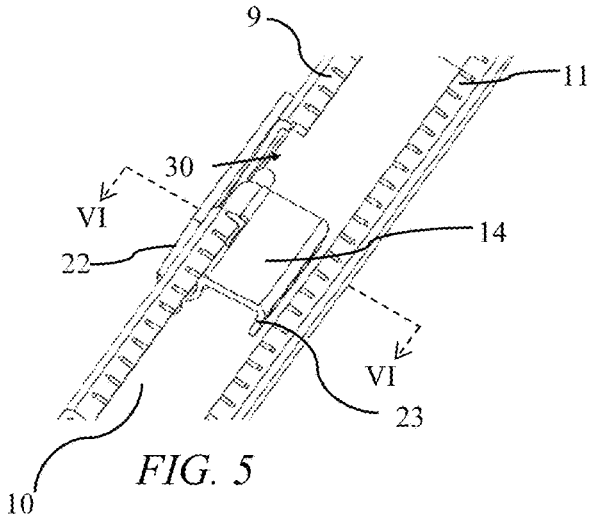
FIG. 5 illustrates a perspective view of a railcar deck channel pivoting side wall system with a pivoting side wall in a down position in an embodiment of the present invention.
Figure 6:
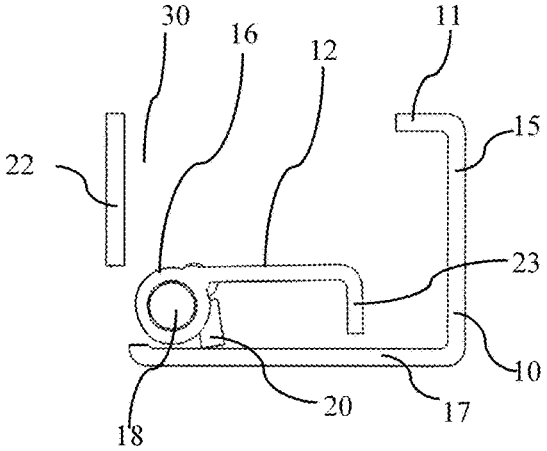
FIG. 6 illustrates a cross-sectional view of a railcar deck channel pivoting side wall system with a pivoting side wall in a down position in an embodiment of the present invention.

The railcar deck channel 10 may have a pivoting side wall 12 disposed in an open section of the first side wall 13 of the railcar deck channel 10 in a preferred embodiment of the present invention. The pivoting side wall 12 may comprise an arm 14 extending from a pivot sleeve 16 that may cooperate with a pin 18. The pivoting side wall 12 may, therefore, pivot around pin 18 between an "up" position, as illustrated in FIGS. 2 and 3 and a "down" position, as illustrated in FIGS. 5 and 6. The arm 14 may comprise a slotted flange 23 extending therefrom, such that the arm 14 and slotted flange 23 may replicate the first side wall 13 and the slotted flange 9 contained for securing an anchor therein.

The pin 18 may be rigidly disposed within the deck channel 10 to prohibit movement of the same. Preferably, the pin 18 may be strategically welded in locations to ensure that the pin 18 is rigidly held in place within the deck channel 10, although it should be noted that the pin may be rigidly held via any means apparent to one of ordinary skill in the art, including bolting of the same within the deck channel 10.

Figure 4:
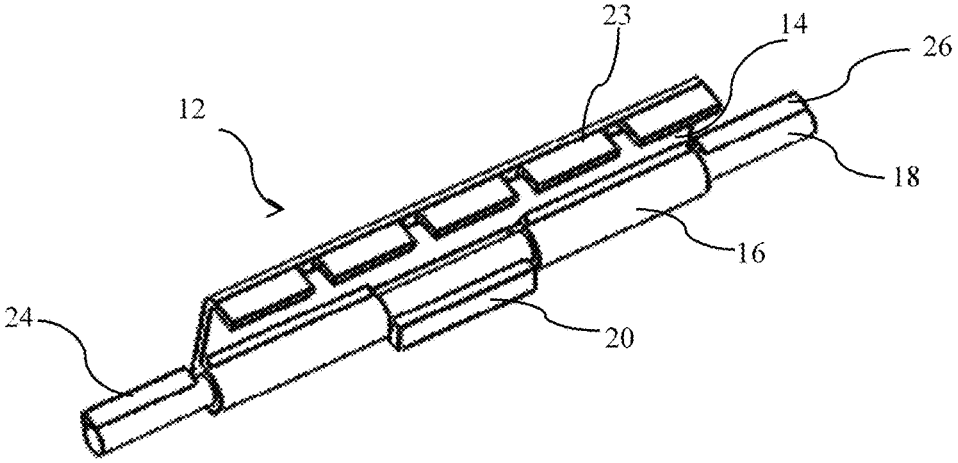
FIG. 4 illustrates a perspective view of a pivoting side wall apparatus for a railcar deck channel in an embodiment of the present invention.

The pivot sleeve 16 may, therefore, be disposed around the pin 18 and may freely move so that the pivot sleeve and, hence, the arm 14, pivots about the pin 18 from the up position to the down position. The 18 pin may further have a pin support 20 that may be a metal block or other relatively strong structural enhancement to ensure that the pin 18 maintains its position within the deck channel 10. The pin support 20 may be welded to the pin 18 and to the bottom wall 17 of the deck channel 10. Additional optional pin supports (such as pin supports 24, 26, as illustrated in FIG. 4) may be welded either to the bottom wall 17 of the deck channel 10 or to the first side wall 13 to add structural strength to the pin 18.

A plate 22 may be rigidly disposed on an outside of the deck channel 10 to act as a block for the pivoting side wall 12 to ensure that the pivoting side wall 12 does not extend past the first side wall 13 of the deck channel 10. The plate 22 may be welded to the outside of the first side wall 13. Again, while the welding of the plate to the first side wall 13 may be preferred, the plate 22 may be rigidly held on the first side wall via any means apparent to one of ordinary skill in the art, including bolting of the same, for example, to the first side wall 13.

Figure 7:
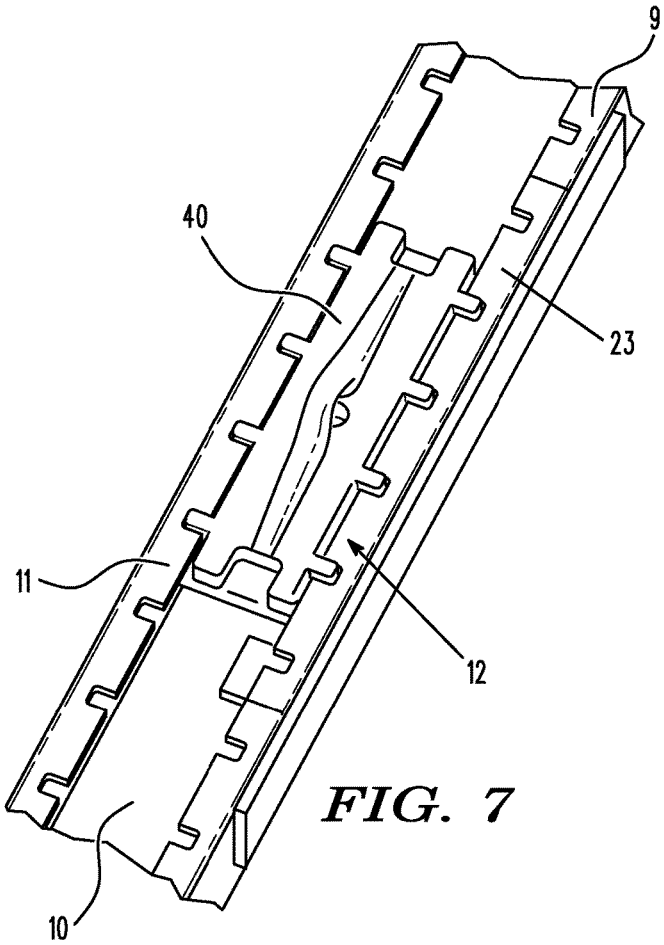
FIG. 7 illustrates a perspective view of a railcar deck channel pivoting side wall system with a pivoting side wall in an up position and a chain or strap anchor disposed within the channel in an embodiment of the present invention.

FIG. 3 illustrates a cross-sectional view of the deck channel 10 with the pivoting side wall 12 along lines III-III in FIG. 2. The cross-sectional view shown in FIG. 3 illustrates the side arm 14 extended in an up position having the slotted flange 23 that replicates the slotted flange 9 on the first side wall 13 of the deck channel 10. The back plate 22 is shown acting as a block or stop for the pivoting side wall 12 to ensure that the pivoting side wall 12 does not over-extend and maintains its place in the up position, thereby ensuring that an anchor may be utilized as normal within the deck channel 10, as illustrated in FIG. 7. The pin support 20 may be welded to the bottom wall 17 of the deck channel 10 via a weld 25, although the pin support 20 may be held via any means apparent to one of ordinary skill in the art.

FIG. 5 illustrates the pivoting side wall 12 disposed in a down position, exposing an opening 30 at the place where the arm 14 and the slotted flange 23 would otherwise be if the pivoting side wall 12 was disposed in the up position. The plate 22, being welded to the deck channel 10 on either side of the opening 30, maintains its position when the pivoting side wall 12 is disposed in the down position.

Figure 8:
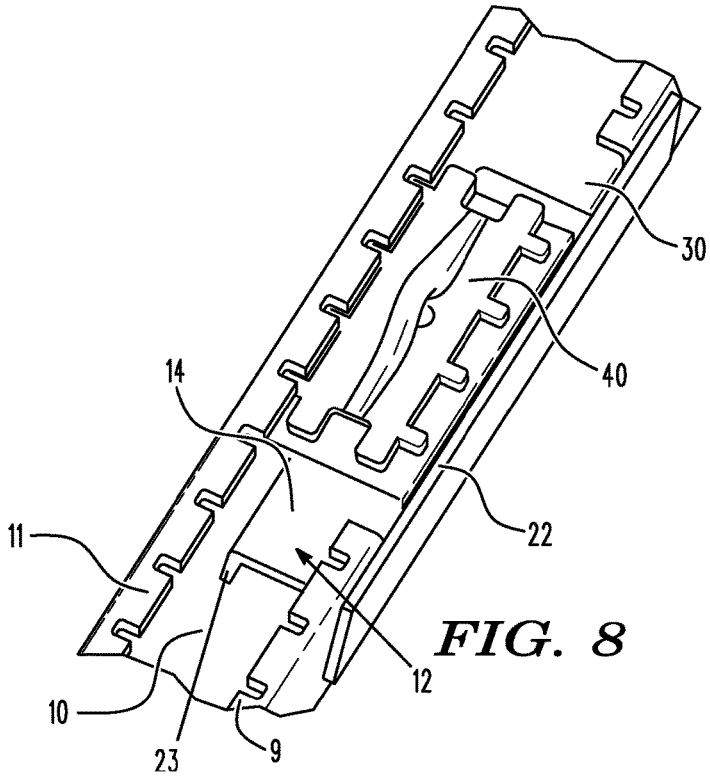
FIG. 8 illustrates a perspective view of a railcar deck channel pivoting side wall system with a pivoting side wall in a down position and a chain or strap anchor disposed within the channel for removal therefrom in an embodiment of the present invention.

The opening 30 allows an anchor (as shown in FIG. 8) to be easily removed or installed in the deck channel, without causing damage to the flanges 11 of the deck channel 10. When pivoted into the down position, the slotted flange 23 may contact the bottom wall 17 of the deck channel 10 and may remain at rest in the down position until moved into an up position for use thereof with an anchor, as shown in FIGS. 7 and 8.

FIG. 6 illustrates a cross-sectional view of the deck channel 10 and the pivoting side wall 12 in a down position along lines VI-VI, as shown in FIG. 5. The opening 30 is shown, allowing for easy removal or installation of anchors within the deck channel 10.

FIG. 7 illustrates an anchor 40 that may be disposed within the deck channel 10, and positioned at the location of the pivoting side wall 12, with the side wall 12 in the up position. Because the slotted flange 23 replicates the slotted flange 9 of the deck channel 10, the anchor 40 may be utilized to tie-down heavy cargo as normal. FIG. 8 illustrates the anchor 40 disposed within the deck channel 10 and positioned at the opening 30 of the first side wall 13, with the pivoting side wall 12 in the down position. The opening 30 allows for easy removal or installation of the anchor 40 when the pivoting side wall 12 is in the down position.

Figure 9A:
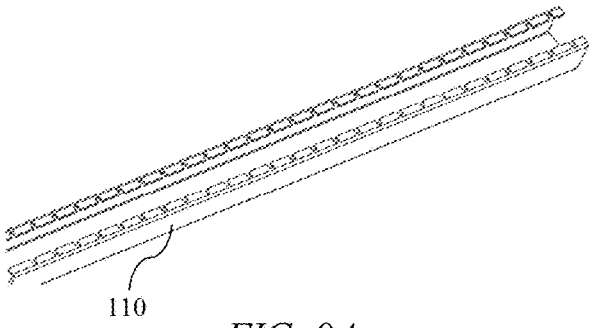
FIGS. 9A-9D illustrates a method of making a railcar deck channel pivoting side wall system in an embodiment of the present invention.
Figure 9B:
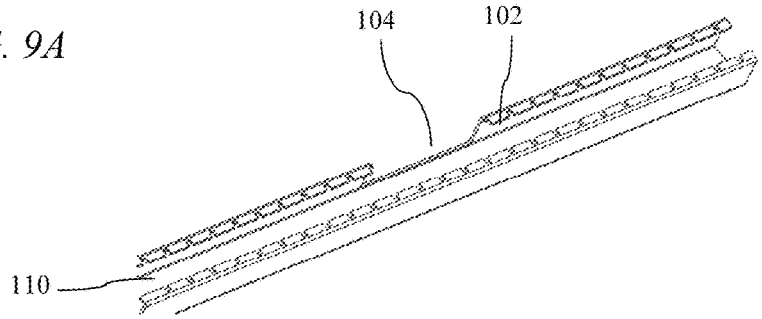

Now referring to FIGS. 9A-9D, a method of making a deck channel pivoting side wall system 100 is described and illustrated. FIG. 9A shows a perspective view of a typical railcar deck channel 110 that may be utilized to hold movable anchors for chain or strap assemblies to tie-down heavy cargo on a railcar deck. The first side wall 102 of the deck channel 100 may be cut, removing a section of the side 102 of the deck channel 100 and forming an opening 104 therein. The section removed may contain the portion of the first side wall 102 of the deck channel 100 and the slotted flange disposed on a top thereof.

Figure 9C:
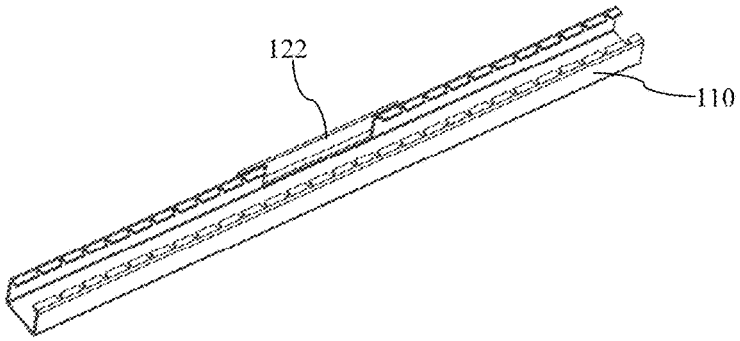
Figure 9D:
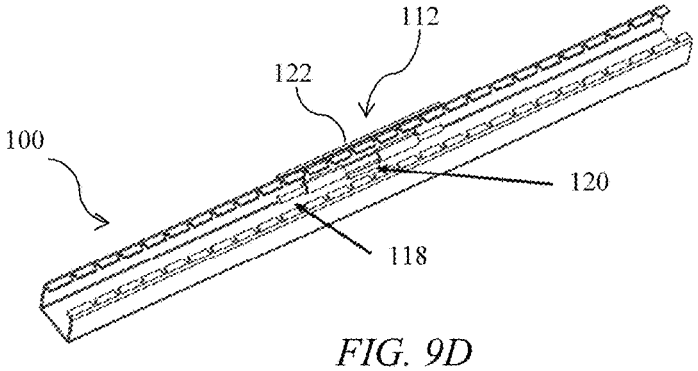

As shown in FIG. 9C, a plate 122 may be welded across the opening 104. In a next step, shown in FIG. 9D, a pivoting side wall 112 may be placed within the opening 100 taking the place of the section removed, as described in FIG. 9B. A pin 118 within sleeve 116 may be welded to the bottom and/or side surfaces of the deck channel 100, as described above.

Although the method described herein includes welding of the various elements together, it should be noted that any means of rigidly holding elements together, whether via bolting or any other means, is contemplated by the present invention, and the invention should not be limited as described herein.

It should be noted that various changes and modifications to the presently preferred embodiments described herein will be apparent to those skilled in the art. Such changes and modifications may be made without departing from the spirit and scope of the present invention and without diminishing its attendant advantages. Further, references throughout the specification to "the invention" are nonlimiting, and it should be noted that claim limitations presented herein are not meant to describe the invention as a whole. Moreover, the invention illustratively disclosed herein suitably may be practiced in the absence of any element which is not specifically disclosed herein.

I claim:

1. A deck channel system on a railcar comprising:

a deck channel comprising a first side wall, a second side wall, and a bottom wall, the first side wall comprising a first flange comprising a first plurality of slots, and the second side wall comprising a second flange comprising a second plurality of slots, the first and second flanges and the first and second plurality of slots configured to hold a securement device within the deck channel, wherein the deck channel further comprises a pivoting side wall section disposed in the first side wall, said pivoting side wall section comprising a side wall portion, and a hinge rigidly held to the bottom wall, wherein said side wall portion pivots on the hinge, wherein the pivoting side wall section has an up position and a down position, said pivoting side wall section disposed in an open section in the first side wall.

2. The deck channel system of claim 1 wherein the side wall portion comprises a third flange comprising a plurality of slots extending from an edge of the side wall portion.

3. The deck channel system of claim 2 wherein the third flange is disposed in alignment with the first flange of the first side wall when the pivoting side wall section is in the up position.

4. The deck channel system of claim 1 wherein the hinge comprises a sleeve rigidly held to the side wall portion, and further wherein a pin disposed within the sleeve is rigidly held to the bottom wall, wherein the sleeve and the pin are configured to allow the side wall portion to pivot between the up position and the down position.

5. The deck channel system of claim 1 wherein the side wall portion, when disposed in the down position, is configured to expose the open section in the first side wall.

6. The deck channel system of claim 5 wherein the securement device is configured to fit through the open section in the first side wall and be disposed within the deck channel when the side wall portion is in the down position.

7. The deck channel system of claim 1 wherein the securement device is a tie-down anchor.

8. The deck channel system of claim 4 wherein the sleeve is welded to the side wall portion and the pin is welded to the bottom wall.

9. The deck channel system of claim 8 wherein the pin is also welded to the first side wall.

10. The deck channel system of claim 1 further comprising:

a plate covering the open section and rigidly held to the first side wall and configured to contact the side wall portion when the side wall portion is in the up position.

11. The deck channel system of claim 1 further comprising:

a securement device held by the first and second flanges and the first and second plurality of slots within the deck channel.

12. A method of securing a securement device within a deck channel on a railcar, the method comprising the steps of:

providing a deck channel comprising a first side wall, a second side wall, and a bottom wall, the first side wall comprising a first flange comprising a first plurality of slots, and the second side wall comprising a second flange comprising a second plurality of slots, the first and second flanges and the first and second plurality of slots configured to hold a securement device within the deck channel, wherein the deck channel further comprises a pivoting side wall section disposed in the first side wall, said pivoting side wall section comprising a side wall portion, and a hinge rigidly held to the bottom wall, wherein said side wall portion pivots on the hinge, wherein the pivoting side wall section has an up position and a down position, said pivoting side wall section disposed in an open section in the first side wall; and moving the pivoting side wall section into the down position, exposing the open section in the first side wall; and placing a securement device into the deck channel through the exposed open section when the pivoting side wall section is in the down position.

13. The method of claim 12 wherein the side wall portion comprises a third flange extending from an edge thereof, the third flange comprising a third plurality of slots, and further comprising the step of:

aligning the third flange of the side wall portion within the first flange of the first side wall when the pivoting side wall section is in the up position.

14. The method of claim 13 further comprising the step of:

securing the securement device to the third flange when the pivoting side wall section is in the up position.

15. The method of claim 12 wherein the securement device is a tie-down anchor.

16. A method of making a pivoting side wall section in a deck channel on a railcar, the method comprising the steps of:

providing a deck channel on a railcar comprising a first side wall, a second side wall, and a bottom wall, the first side wall comprising a first flange comprising a first plurality of slots, and the second side wall comprising a second flange comprising a second plurality of slots, the first and second flanges and the first and second plurality of slots configured to hold a securement device within the deck channel;

removing a section of the first side wall to form an open section in the first side wall;

providing a pivoting side wall section comprising a side wall portion and a hinge;

rigidly connecting the hinge to the deck channel so that the pivoting side wall section pivots between an up position and a down position.

17. The method of claim 16 wherein the hinge comprises a sleeve rigidly held to the side wall portion and a pin, wherein the pin is rigidly connected to the bottom wall of the deck channel.

18. The method of claim 16 wherein the pivoting side wall section further comprises a third flange extending from an edge of the side wall portion, wherein the flange comprises a third plurality of slots and further wherein the third flange of the pivoting side wall section is in alignment with the first flange of the first side wall when the pivoting side wall section is in the up position.

19. The method of claim 16 further comprising the step of:

welding a plate to the first side wall covering the open section in the first side wall to contact the pivoting side wall section when the pivoting side wall section is in the up position.

20. The method of claim 16 further comprising the step of:

welding a portion of the hinge to the bottom wall of the railcar deck channel so that the pivoting side wall section pivots on the hinge between the up position and the down position.

* * * * *